US005359399A

United States Patent [19]

Bares et al.

[11] Patent Number: 5,359,399

[45] Date of Patent: Oct. 25, 1994

[54] HYBRID SCAVENGELESS DEVELOPER UNIT HAVING A MAGNETIC TRANSPORT ROLLER

[75] Inventors: Jan Bares; Cyril G. Edmunds, both of Webster, N.Y.

[73] Assignee: Xerox Corporation, Stamford, Conn.

[21] Appl. No.: 105,238

[22] Filed: Aug. 12, 1993

[51] Int. Cl.[5] ..... G03G 15/06

[52] U.S. Cl. ..... 355/259; 118/657; 355/253

[58] Field of Search ..... 355/245, 251, 253, 259; 118/653, 656–658; 222/DIG. 1

[56] References Cited

U.S. PATENT DOCUMENTS

| | | | |
|---|---|---|---|
| 3,392,432 | 7/1968 | Naumann | 118/657 |
| 3,643,311 | 2/1972 | Knechtel et al. | 118/657 X |
| 4,252,434 | 2/1981 | Nakamura et al. | 355/251 X |
| 4,457,257 | 7/1984 | Murakami et al. | 355/251 X |
| 4,480,911 | 11/1984 | Itaya et al. | 355/251 |
| 4,540,272 | 9/1985 | Abe et al. | 355/253 X |
| 4,868,600 | 9/1989 | Hays et al. | 355/259 |
| 4,984,019 | 1/1991 | Folkins | 355/215 |
| 5,063,399 | 11/1991 | Zeman et al. | 355/251 X |

FOREIGN PATENT DOCUMENTS

| | | | |
|---|---|---|---|
| 56-109374 | 8/1981 | Japan | 355/251 |
| 60-91373 | 5/1985 | Japan | 355/253 |
| 61-52665 | 3/1986 | Japan | 355/253 |
| 63-223676 | 9/1988 | Japan | 355/251 |
| 3-59690 | 3/1991 | Japan | 355/253 |
| 3-168782 | 7/1991 | Japan | 355/251 |

*Primary Examiner*—William J. Royer

*Attorney, Agent, or Firm*—H. Fleischer; J. E. Beck; R. Zibelli

[57] ABSTRACT

An apparatus in which an electrostatic latent image recorded on a photoconductive member is developed with toner. A donor roll, spaced from the photoconductive member, transports toner to a development zone adjacent the photoconductive member. An electrode member is positioned in the development zone between the photoconductive member and the donor roll. The electrode member is electrically biased to detach toner from the donor roll so as to form a toner powder cloud in the space between the electrode member and the photoconductive member. A unitary magnetic roll is located in the housing to transport developer material to a reload zone where toner particles are attracted from magnetic carrier granules to the donor roll. The parameters are selected to optimize reload and suppress strobe lines.

14 Claims, 2 Drawing Sheets

HYBRID SCAVENGELESS DEVELOPER UNIT HAVING A MAGNETIC TRANSPORT ROLLER

This invention relates generally to an electrophotographic printing machine, and more particularly concerns a magnetic transport roller adapted to advance magnetic carrier granules having toner particles that adhere triboelectrically thereto a donor roller used in a scavengeless development system. Generally, the process of electrophotographic printing includes charging a photoconductive member to a substantially uniform potential so as to sensitize the photoconductive surface thereof. The charged portion of the photoconductive member is exposed to a light image of an original document being reproduced. This records an electrostatic latent image on the photoconductive member. After the electrostatic latent image is recorded on the photoconductive member, the latent image is developed by bringing a developer material into contact therewith. Two component and single component developer materials are commonly used. A typical two component developer material includes magnetic carrier granules having toner particles adhering triboelectrically thereto. A single component developer material typically comprises toner particles. Toner particles are attracted to the latent image forming a toner powder image on the photoconductive member. The toner powder image is subsequently transferred to a copy sheet. Finally, the toner powder image is heated to permanently fuse it to the copy sheet and image configuration.

One type of single component development system is a scavengeless development system that uses a donor roll for transporting charged toner to the development zone. A plurality of electrode wires are closely spaced to the donor roll in the development zone. An AC voltage is applied to the wires forming a toner cloud in the development zone. The electrostatic fields generated by the latent image attract toner from the toner cloud to develop the latent image. A hybrid scavengeless development system employs a magnetic brush developer roller for transporting carrier having toner particles adhering triboelectrically thereto. The donor roll and magnetic roll are electrically biased relative to one another. Toner is attracted to the donor roll from the magnetic roll. The electrically biased electrode wires detach the toner from the donor roll forming a toner powder cloud in the development zone. The latent image attracts the toner particles from the toner powder cloud. In this way, the latent image recorded on the photoconductive member is developed with the toner particles. The hybrid scavengeless developer unit employs a magnetic roller. The magnetic roller heretofore used was a stationary magnet having a sleeve disposed thereabout. The sleeve is rotated and advances the developer material adjacent the donor roller. A magnetic roller of this type is relatively expensive to manufacture. Accordingly, it is highly desirable to reduce the manufacturing cost of the magnetic roller used in a hybrid scavengeless development system without decreasing the quality thereof.

The following disclosures may be relevant to various aspects of the present invention:

U.S. Pat. No. 3,392,432 Patentee: Naumann Issued: Dec. 16, 1964

U.S. Pat. No. 4,868,600 Patentee: Hays et al. Issued: Sep. 19, 1989

U.S. Pat. No. 4,984,019 Patentee: Folkins Issued: Jan. 8, 1991

The relevant portions of the foregoing disclosures may be briefly summarized as follows:

U.S. Pat. No. -A-3,392,432 discloses a magnetic roll which transports developer material to a development zone. In the development zone, toner particles are attracted from the magnetic carrier granules of the developer material to the latent image. In this way, the latent image is developed with the toner particles.

U.S. Pat. No. -A-4,868,600 describes a scavengeless development system in which toner is detached from a donor roll and a powder cloud formed by AC electrically biased electrode wires. The donor roll is electrically biased by DC voltage. A magnetic roller transports two component developer material to a loading region with toner from the magnetic roller transferred to the donor roll. The magnetic roller includes a stationary magnet having a sleeve disposed thereabout. As the sleeve rotates, the developer material is advanced to the loading zone.

U.S. Pat. No. -A-4,984,019 discloses a developer unit having a donor roll with electrode wires disposed adjacent thereto in a development zone. A magnetic roller transports developer material to the donor roll. Toner particles are attracted from the magnetic roller to the donor roller. The magnetic roller includes a stationary magnet having a rotating sleeve disposed thereabout.

In accordance with one aspect of the present invention, there is provided an apparatus for developing a latent image recorded on a surface with toner. The apparatus includes a transport member, spaced from the surface, for moving toner to a development zone adjacent the surface to develop the latent image recorded thereon. A unitary magnetic member positioned adjacent the transport member, advances developer material to a position adjacent the transport member. The developer material is attracted from the magnetic member to the transport member.

Pursuant to another aspect of the present invention, there is provided an electrophotographic machine of the type in which an electrostatic latent image recorded on a photoconductive member is developed with toner to form a visible image thereof. The improvement includes a transport member, spaced from the photoconductive member, for moving toner to a development zone adjacent the photoconductive member. The toner develops the latent image recorded on the photoconductive member. A unitary magnetic member, positioned adjacent the transport member, advances toner to a position adjacent the transport roller with toner being attracted to said transport member.

Other features of the present invention will become apparent as the following description proceeds and upon reference to the drawings, in which.

While the present invention will be described in connection with a preferred embodiment thereof, it will be understood that it is not intended to limit the invention to this embodiment. On the contrary, it is intended to cover all alternatives, modifications and equivalents as may be included within the spirit and scope of the invention as defined by the appended claims.

Inasmuch as the art of electrophotographic printing is well known, the various processing stations employed in the FIG. 3 printing machine will be shown hereinafter schematically and their operation described briefly with reference thereto.

Figure 3:
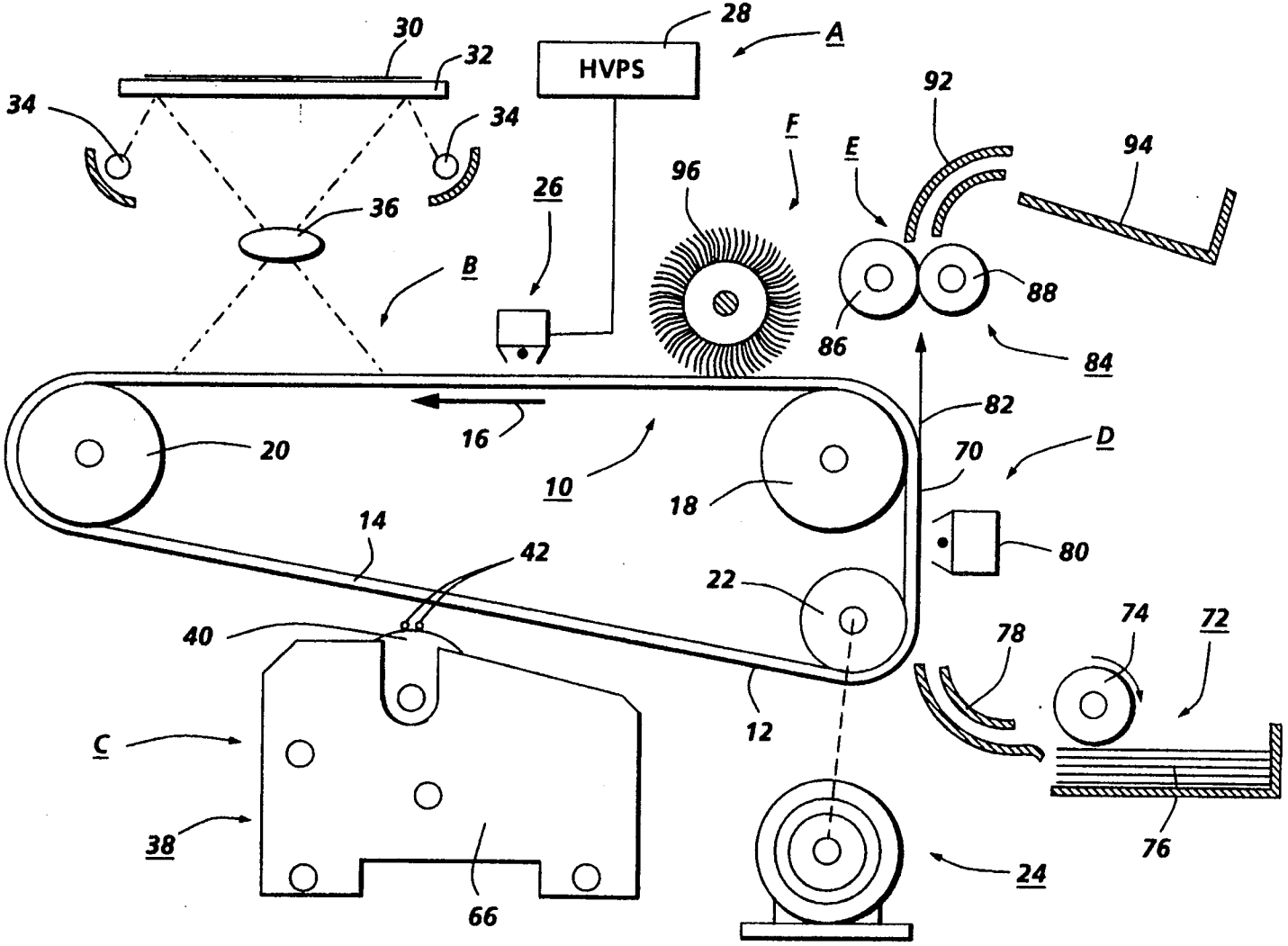
FIG. 3 is a schematic elevational view of an illustrative electrophotographic printing machine incorporating the FIG. 2 development apparatus therein.

Referring initially to FIG. 3, there is shown an illustrative electrophotographic printing machine incorporating the development apparatus of the present invention therein. The electrophotographic printing machine employs a belt 10 having a photoconductive surface 12 deposited on a conductive substrate 14. Preferably, photoconductive surface 12 is made from a selenium alloy. Conductive substrate 14 is made preferably from an aluminum alloy that is electrically grounded. One skilled in the art will appreciate that any suitable photoconductive belt may be used. Belt 10 moves in the direction of arrow 16 to advance successive portions of photoconductive surface 12 sequentially through the various processing stations disposed about the path of movement thereof. Belt 10 is entrained about stripping roller 18, tensioning roller 20 and drive roller 22. Drive roller 22 is mounted rotatably in engagement with belt 10. Motor 24 rotates drive roller 22 by suitable means such as a belt drive. Belt 10 is maintained and tensioned by a pair of springs (not shown) resiliently urging tensioning roller 20 against belt 10 with the developed spring force. Stripping roller 18 and tensioning roller 20 are mounted to rotate freely.

Initially, a portion of belt 10 passes through charging station A. At charging station A, a corona generating device, indicated generally by the reference numeral 26, charges photoconductive surface 12 to a relatively high, substantially uniform potential. High voltage power supply 28 is coupled to corona generating device 26 to charge photoconductive surface 12 of belt 10. After photoconductive surface 12 of belt 10 is charged, the charged portion thereof is advanced through exposure station B.

At exposure station B, an original document 30 is placed face down upon a transparent platen 32. Lamps 34 flash light rays onto original document 30. The light rays reflected from original document 30 are transmitted through lens 36 to form a light image thereof. Lens 36 focuses the light image onto the charged portion of photoconductive surface 12 to selectively dissipate the charge thereon. This records an electrostatic latent image on photoconductive surface 12 which corresponds to the informational areas contained within original document 30. Alternatively, a raster output scanner may be used in lieu of the light lens system previously described to lay out an image in a series of horizontal scan lines with each line having a specified number of a pixels per inch. Typically, a raster output scanner includes a laser with a rotating polygon mirror block and a modulator.

After the electrostatic latent image has been recorded on photoconductive surface 12, belt 10 advances the latent image to development station C. At development station C, a developer unit, indicated generally by the reference numeral 38, develops the latent image recorded on the photoconductive surface. Preferably, developer unit 38 includes donor roll 40 and electrode wires 42. Electrode wires 42 are electrically biased relative to donor roll 40 to detach toner therefrom so as to form a toner powder cloud in the gap between the donor roll and the photoconductive surface. The latent image attracts toner particles from the toner powder cloud forming a toner powder image thereon. Donor roll 40 is mounted, at least partially, in the chamber of developer housing 66. The chamber of developer housing 66 stores a supply of developer material. The developer material may be a single component developer material of magnetic toner particles or, alternatively, a developer material including at least magnetic carrier granules having toner particles adhering triboelectrically thereto. In addition to an alternating voltage, electrode wires 42 are electrically biased with a constant voltage. Developer unit 38 will be described in further detail with reference to FIGS. 1 and 2.

With continued reference to FIG. 3, after the electrostatic latent image is developed, belt 10 advances the toner powder image to transfer station D. A copy sheet 70 is advanced to transfer station D by sheet feeding apparatus 72. Preferably, sheet feeding apparatus 72 includes a feed roll 74 contacting the uppermost sheet of stack 76. Sheet feeding apparatus 72 advances sheet 70 into chute 78. Chute 78 directs the advancing sheet of support material into contact with photoconductive surface 12 of belt 10 in a timed sequence so that the toner powder image developed thereon contacts the advancing sheet at transfer station D. Transfer station D includes a corona generating device 80 which sprays ions onto the back side of sheet 70. This attracts the toner powder image from photoconductive surface 12 to sheet 70. After transfer, sheet 70 continues to move in the direction of arrow 82 onto a conveyor (not shown) that advances sheet 70 to fusing station E.

Fusing station E includes a fuser assembly, indicated generally by the reference numeral 84, which permanently affixes the transferred powder image to sheet 70. Fuser assembly 84 includes a heated fuser roller 86 and a back-up roller 88. Sheet 70 passes between fuser roller 86 and back-up roller 88 with the toner powder image contacting fuser roller 86. In this manner, the toner powder image is permanently affixed to sheet 70. After fusing, sheet 70 advances through chute 92 to catch tray 94 for subsequent removal from the printing machine by the operator.

After the sheet is separated from photoconductive surface 12 of belt 10, the residual toner particles adhering to photoconductive surface 12 are removed therefrom at cleaning station F. Cleaning station F includes a rotatably mounted fibrous brush 96 in contact with photoconductive surface 12. The particles are cleaned from photoconductive surface 12 by the rotation of brush 96 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

Figure 1:
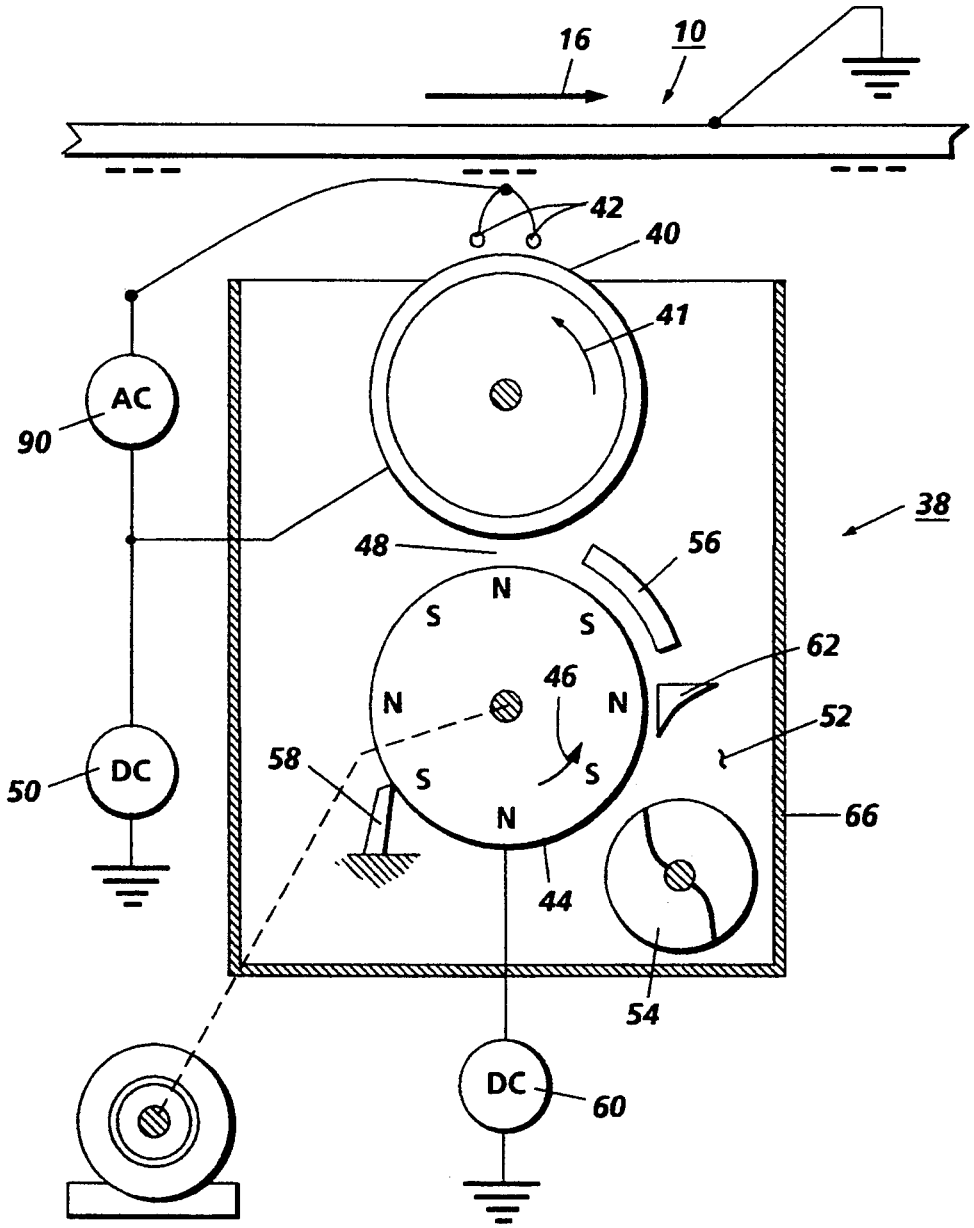
FIG. 1 is a schematic elevational view showing the development apparatus used in the FIG. 3 printing machine.

Referring now to FIG. 1, therein is shown developer unit 38 in greater detail. As shown thereat, developer unit 38 includes a donor roll 40, electrode wires 42 and magnetic roll 44. Donor roll 40 conveys developer material comprising toner loaded thereon by magnetic roll 44. The donor roll can be rotated in either the "with" or "against" direction relative to the direction of motion of belt 10. The donor roll is shown rotating in the direction of arrow 41.

Electrode wires 42 are located in the space between photoconductive surface 12 and donor roll 40. The electrode wires include one or more thin tungsten wires which are lightly positioned against donor roll 40. The space between the electrode wires is preferably about 1.9 mm. The distance between the wires and the donor roll is approximately the thickness of the toner layer on the donor roll. The extremities of the wire are supported by the tops of end bearing blocks (not shown) which may also be used to support the donor roll for rotation.

An AC electrical bias is applied to electrode wires by AC voltage source 90. In addition, a DC power supply 50 electrically biases electrode wires 42 and donor roll 40. DC power supply 50 establishes an electrostatic field between photoconductive surface 12 and donor roll 40 for attracting the detached toner particles from the cloud surrounding wires 42 to the latent image recorded on the photoconductive surface. Preferably, donor roll 40 has a diameter of about 16 mm. The donor roll has a tangential velocity preferably of about 145 mm per second at an angular velocity of about 172 revolutions per minute. The foregoing parameters are for a photoconductive belt having a velocity of about 63.5 mm per second.

Magnetic roll 44, rotating in the direction of arrow 46, is a cylindrical magnet with an even number of alternating north and south magnetic poles equally spaced about the circumferential surface thereof. As shown in FIG. 1, a magnetic roll 44 has six magnetic poles. The diameter of magnetic roll 44 is preferably about 18 min. Magnetic roll 44 rotates, in the direction of arrow 46, at a tangential velocity of about 560 mm per second at an angular velocity of about 594 revolutions per minute. The ratio of the tangential velocity of the magnetic roll to the donor roll is about 3.85, with the ratio of the tangential velocity of the donor roll to the photoreceptor velocity being about 2.29. As magnetic roll 44 rotates in the direction of arrow 46, it advances the developer material to loading zone 48. The width of the loading zone is about 3.31 min. In loading zone 48, toner particles are attracted from the carrier granules on magnetic roll 44 to donor roll 40. Scraper blade 58 removes the denuded carrier granules and extraneous developed material from the surface of magnetic roll 44. Metering blade 62 adjusts the quantity of developer material being advanced to the loading zone 48.

As successive electrostatic latent images are developed, the toner particles within the developer material are depleted. Auger 54 is mounted rotatably in chamber 52 of housing 66 and mixes fresh toner particles with the remaining developer material so that the resultant developer material therein is substantially uniform with the concentration of toner particles being optimized. In order to translate the developer material in a longitudinal direction on magnetic roll 44, an arcuate plate 56 having threads or vanes therein is employed. Plate 56 extends substantially parallel to the longitudinal axis of magnetic roll 44 and along the length thereof. When such a plate is employed, it may perform two functions. One of these functions is to control the thickness of the developer material on magnetic roll 44 and, inasmuch as the threads are in a spiral, cause the developer material to translate as magnetic roll 44 rotates in the direction of arrow 46. The translation of the developer material in the longitudinal direction facilitates intermingling of the newly added toner particles with the denuded carrier granules and developer material remaining in chamber 52 of housing 66. Under these latter circumstances, metering blade 62 may be redundant.

A DC power supply 60 establishes an electrostatic field between donor roll 40 and magnetic roll 44. This electrostatic field attracts the toner particles adhering to the carrier granules on magnetic roll 44 to donor roll 40.

Figure 2:
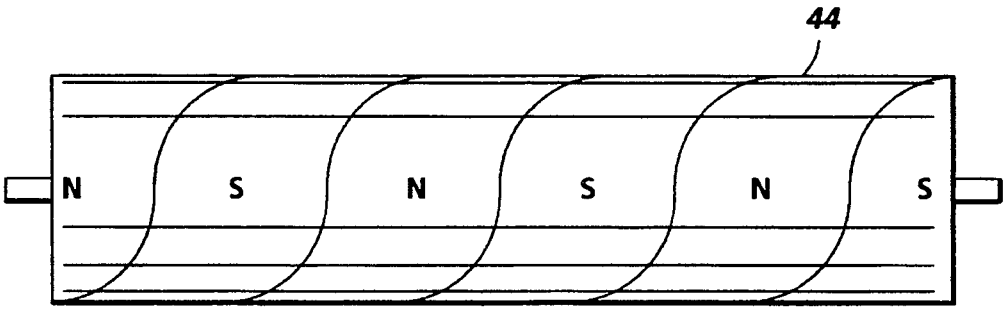
FIG. 2 is a schematic elevational view illustrating one embodiment of a magnetic roll used in the FIG. 1 development system.

Referring now to FIG. 2, therein is shown an alternate embodiment of magnetic roll 44. As shown thereat, magnetic roll 44 has a helical pattern of magnetic poles formed thereon. When a helically magnetized magnetic roll is employed, the angle of the vanes or threads of plate 56 and that of the magnetic poles on roll 44 should be substantially equal to one another to minimize the force required to move the developer material in the longitudinal direction. In addition to potentially eliminating the need for a metering blade, auger 54 may no longer be required and may be redundant as well in such a system. Thus, the cost of manufacturing a developer unit of this type may be significantly reduced by the elimination of the metering blade and auger. A developer unit of this type has a relatively high speed ratio between the magnetic roll and photoreceptor. This insures that the reloading of toner from the magnetic roll to the donor roll will be efficient while decreasing the amplitude of visible strobe lines on the copy sheet. By the appropriate selection of the reload speed, and spacing between electrode wires, strobe lines may be averaged out during the development process. Thus, it is seen that developer unit of the type described herein will significantly reduce the effects of strobe lines resulting in a higher quality copy at lower cost.

In recapitulation, it is evident that the development unit of the present invention includes electrodes positioned closely adjacent to the exterior surface of a donor roll in a gap defining the development zone between the donor roll and the photoconductive belt. A unitary magnetic roll transports toner particles to a reload zone where they are transferred from the magnetic roll to the donor roll. The utilization of a unitary magnetic roll to achieve the foregoing enables higher speed reloading and significant reduction in strobe lines effects.

It is, therefore, apparent that there has been provided in accordance with the present invention, a development system that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications, and variations that fall within the spirit and broad scope of the appended claims.

It is claimed:

1. An apparatus for developing a latent image recorded on a surface with toner, including:

a donor roll, spaced from the surface, for moving developer material to a development zone adjacent the surface to develop the latent image recorded thereon;

a unitary magnetic roll, positioned adjacent said donor roll, for advancing developer material to a position adjacent said donor roll with toner being attracted to said donor roll;

a housing defining a chamber storing a supply of developer material therein, said magnetic roll being disposed in the chamber of said housing with said donor roll being disposed, at least partially, in the chamber of said housing, interposed between the surface and said magnetic roll;

an electrode member positioned in the development zone between the surface and said donor roll; and means for electrically biasing said electrode member to detach toner from said donor roll to form a cloud of toner in the space between said electrode member and the surface with the toner developing the latent image recorded on the surface.

2. An apparatus according to claim 1, wherein the developer material includes magnetic toner particles.

3. An apparatus according to claim 1, wherein the developer material includes magnetic carrier granules and non-magnetic toner particles.

4. An apparatus according to claim 1, wherein said electrode member includes a plurality of wires.

5. An apparatus for developing a latent image recorded on a surface with toner, including:

a donor roll, spaced from the surface, for moving developer material to a development zone adjacent the surface to develop the latent image recorded thereon;

a unitary magnetic roll, positioned adjacent said donor roll, for advancing developer material to a position adjacent said donor roll with toner being attracted to said donor roll;

a housing, defining a chamber storing a supply of developer material therein, said magnetic roll being disposed in the chamber of said housing with said donor roll being disposed, at least partially in the chamber of said housing interposed between the surface and said magnetic roll; and means, disposed in the chamber of said housing for moving developer material from a first region of the chamber to a second region of the chamber of said housing, said moving means includes a member disposed adjacent a portion of said magnetic roll, having a spiral groove therein so as to move developer material from the first region to the second region as said magnetic roll rotates.

6. An apparatus according to claim 5, wherein said magnetic roll includes an even number of alternating magnetic north poles and magnetic south poles with the magnetic poles being substantially equally spaced from one another about the circumferential surface of said magnetic roll.

7. An apparatus according to claim 5, wherein said magnetic roll includes alternating magnetic north poles and magnetic south poles arranged in a spiral about the circumferential surface of said magnetic roll to move developer material from the first region to the second region as said magnetic roll rotates.

8. An electrophotographic printing machine of the type in which an electrostatic latent image recorded on a photoconductive member is developed with toner to form a visible image thereof, wherein the improvement includes:

a donor roll, spaced from the photoconductive member, for moving toner to a development zone adjacent the photoconductive member to develop the latent image recorded thereon;

a unitary magnetic roll, positioned adjacent said donor roll, for advancing toner to a position adjacent said donor roll with toner being attracted to said donor roll;

a housing, defining a chamber storing a supply of toner therein, said magnetic roll being disposed in the chamber of said housing with said donor roll being disposed, at least partially in the chamber of said housing, interposed between the photoconductive member and said magnetic roll;

an electrode member positioned in the development zone between the photoconductive member and said donor roll; and means for electrically biasing said electrode member to detach toner from said donor roll to form a cloud of toner in the space between said electrode member and the photoconductive member with the toner developing the latent image recorded on the photoconductive member.

9. A printing machine according to claim 8, wherein said donor member moves magnetic carrier granules having toner adhereing triboelectrically hereto.

10. A printing machine according to claim 8, wherein the toner includes magnetic toner particles.

11. A printing machine according to claim 8, wherein said electrode member includes a plurality of wires.

12. An electrophotographic printing machine of the type in which an electrostatic latent image recorded on a photoconductive member is developed with toner to form a visible image thereof, wherein the improvement includes:

a donor roll, spaced from the photoconductive member for moving toner to a development zone adjacent the photoconductive member to the latent image recorded thereon;

a unitary magnetic roll, positioned adjacent said donor roll for advancing toner to a position adjacent said donor roll with toner being attracted to said donor roll;

a housing, defining a chamber storing a supply of toner therein, said magnetic roll being disposed in the chamber of said housing with said donor roll be disposed, at least partially in the chamber of said housing, interposed between the photoconductive member and said magnetic roll; and means, disposed in the chamber of said housing, for moving the toner from a first region of the chamber to a second region of the chamber of said housing, said moving means includes a member, disposed adjacent a portion of said magnetic roll, having a spiral groove therein so as to move toner from the first region to the second region as said magnetic roll rotates.

13. A printing machine according to claim 12, wherein said magnetic roll includes an even number of magnetic north poles with the magnetic poles being substantially equally spaced from one another about the circumferential surface of said magnetic roll.

14. A printing machine according to claim 12, wherein said magnetic roll includes alternating magnetic north poles and magnetic south poles arranged in a spiral about the circumferential surface of said magnetic roll to move toner from the first region to the second region as said magnetic roll rotates.

* * * * *